US007832841B2

(12) United States Patent
Moriyama et al.

(10) Patent No.: US 7,832,841 B2
(45) Date of Patent: Nov. 16, 2010

(54) PRINTING APPARATUS AND PRINTING METHOD FOR DISCHARGING FINE INK DROPLETS USING AN ION EMITTER

(75) Inventors: Jiro Moriyama, Kawasaki (JP); Atsuhiko Masuyama, Yokohama (JP); Yoshiaki Takayanagi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 768 days.

(21) Appl. No.: 11/721,503

(22) PCT Filed: Dec. 21, 2005

(86) PCT No.: PCT/JP2005/023998

§ 371 (c)(1),
(2), (4) Date: Jun. 12, 2007

(87) PCT Pub. No.: WO2006/068290

PCT Pub. Date: Jun. 29, 2006

(65) Prior Publication Data

US 2008/0012924 A1 Jan. 17, 2008

(30) Foreign Application Priority Data

Dec. 22, 2004 (JP) ..... 2004-371891

(51) Int. Cl.
*B41J 2/06* (2006.01)

(52) U.S. Cl. ..... 347/55; 347/54; 347/36

(58) Field of Classification Search ..... 347/34, 347/36, 54, 55, 103
See application file for complete search history.

(56) References Cited

U.S. PATENT DOCUMENTS

| | | | | |
|---|---|---|---|---|
| 4,478,510 | A * | 10/1984 | Fujii et al. | 347/55 |
| 4,668,959 | A | 5/1987 | Jochimsen et al. | 347/34 |
| 4,788,564 | A * | 11/1988 | Ochiai | 347/55 |
| 5,646,659 | A | 7/1997 | Moriyama et al. | |
| 5,896,148 | A | 4/1999 | Fukushima et al. | |
| 6,036,302 | A | 3/2000 | Hotomi | |
| 6,802,591 | B2 | 10/2004 | Takahashi | |
| 7,014,292 | B2 | 3/2006 | Yazawa et al. | |
| 7,156,515 | B2 | 1/2007 | Iwata | 347/102 |
| 2002/0033865 | A1 | 3/2002 | Ishinaga et al. | |
| 2004/0027412 | A1 | 2/2004 | Takahashi et al. | |
| 2004/0061738 | A1 | 4/2004 | Unosawa | |
| 2006/0092214 | A1 | 5/2006 | Yazawa et al. | |
| 2008/0018707 | A1 | 1/2008 | Masuyama et al. | 347/55 |

FOREIGN PATENT DOCUMENTS

CN 86108108 A 12/1987

(Continued)

*Primary Examiner*—Juanita D Stephens
(74) *Attorney, Agent, or Firm*—Fitzpatrick, Cella, Harper & Scinto

(57) ABSTRACT

There are provided a printing apparatus and printing method capable of achieving high-quality printing by fine ink droplets, and collecting unwanted ink droplets. According to the method, ink droplets discharged from a printhead are negatively charged by the negative ions in printing. A printing medium is charged positively opposite to the polarity of ink droplets. By the electrostatic force, discharged ink droplets travel toward the printing medium, and the amount of ink droplets attached to the printing medium is increased. In addition, an ink mist collecting unit having a positive electrode is employed to collect floating ink mist.

16 Claims, 11 Drawing Sheets

FOREIGN PATENT DOCUMENTS

| | | | |
|---|---|---|---|
| CN | 1498685 | A | 5/2004 |
| EP | 0 473 178 | | 3/1992 |
| EP | 0 473 179 | | 3/1992 |
| EP | 0 747 220 | | 12/1996 |
| EP | 0 795 414 | | 9/1997 |
| EP | 0 832 742 | | 4/1998 |
| EP | 1 284 197 | | 2/2003 |
| JP | 4-083645 | | 3/1992 |
| JP | 5-008392 | | 1/1993 |
| JP | 5-104724 | | 4/1993 |
| JP | 5-124187 | | 5/1993 |
| JP | 7-237296 | | 9/1995 |
| JP | 8-187842 | | 7/1996 |
| JP | 2002-211005 | | 7/2002 |
| JP | 2003-014773 | | 1/2003 |
| JP | 2003-305840 | | 10/2003 |
| JP | 2004-202867 | | 7/2004 |
| WO | WO 95/11807 | | 5/1995 |
| WO | WO 2006/068281 | | 6/2006 |

* cited by examiner

PRINTING APPARATUS AND PRINTING METHOD FOR DISCHARGING FINE INK DROPLETS USING AN ION EMITTER

TECHNICAL FIELD

This invention relates to a printing apparatus and printing method, and more particularly to a printing apparatus and printing method using an inkjet printhead which prints by, e.g., discharging fine ink droplets onto a printing medium.

BACKGROUND ART

An inkjet printing apparatus forms an image by fixing small ink droplets serving as a coloring material onto the surface of a printing medium. Recently, printing is done on a printing medium by using not only four conventional color inks including cyan (C), magenta (M), and yellow (Y) color inks and black (Bk) ink, but also low-density inks of similar colors (e.g., light magenta and light cyan), and orange, blue, green, and skin color inks.

The volume of one ink droplet used in the inkjet printing apparatus decreases to 1.0 pl (picoliter) in order to meet recent demands for higher image quality.

An ink droplet 1.0 pl in volume is regarded as mist, and it becomes difficult to control ink droplets in such a small volume one by one.

From the viewpoint of high printing quality, it is desired to attach droplets of, e.g., 1.0 pl or less onto desired positions on a printing medium at a precision of micron order. However, it is difficult to obtain the desired precision under the influence of a peripheral air flow. Immediately after discharging ink, fine ink droplets called "satellites" which are produced when originally one ink droplet is broken into a plurality of ink droplets may attach to unintended positions or float in space.

For this reason, it is difficult to accurately attach all droplets to desired printing positions.

If the above-mentioned satellites or ink droplets bounded back from the surface of a printing medium float in the air to accumulate fine ink droplets, the fine ink droplets contaminate the interior of the printing apparatus to degrade the movable characteristic of the movable portion of the printing apparatus. In addition, fine ink droplets cause various sensors to malfunction, or gathered floating mist attaches to the upper surface of a printing medium or the backside of the next printing medium to contaminate it.

In order to solve this problem, there has conventionally been proposed a method of charging ink droplets and controlling them in an inkjet printing apparatus.

For example, in Japanese Patent Publication Laid-Open No. 5-008392, the electric field is controlled to be applied between a printhead and a printing medium and to be stopped during ink discharge. This control prevents positive or negative charging of ink droplets by the electric field and a failure of ink charged to either polarity in attaching to a printing medium.

Japanese Patent Publication Laid-Open No. 5-104724 proposes a method of injecting charges into ink in the printhead and attracting ink toward a printing medium.

Japanese Patent Publication Laid-Open No. 5-124187 proposes a method of controlling the electric field and discriminately controlling main droplets and subsequent satellite droplets.

Japanese Patent Publication Laid-Open No. 2002-211005 proposes a method of positively or negatively charging each of plural types of inks and capturing mist by an electrode.

Japanese Patent Publication Laid-Open No. 2003-014773 proposes a method of charging ink by an ionizer and collecting ink droplets.

The techniques disclosed in these prior arts have the following problems.

In order to implement high-speed printing, control of the electric field according to Japanese Patent Publication Laid-Open No. 5-008392 must be performed at a very high frequency. It is practically difficult to perform such control, or high-speed printing is limited. Electromagnetic waves are generated by high-frequency control of the electric field and act as a noise source, degrading the reliability and safety of the printing apparatus.

In the method according to Japanese Patent Publication Laid-Open No. 5-104724, polarization occurs because, when a fine droplet is discharged from the printhead, it elongates in the discharge direction and is broken into a plurality of droplets. Upon polarization, a fine droplet is charged positively or negatively. A fine droplet may be attracted to a printing medium or repulsed by the printing medium. It is difficult to control a fine droplet.

In the method according to Japanese Patent Publication Laid-Open No. 5-124187, polarization as described above occurs, and separation of satellite droplets slightly changes one by one. It is, therefore, difficult to accurately control a satellite droplet.

In the method according to Japanese Patent Publication Laid-Open No. 2002-211005, the structure of the printing apparatus becomes complicated because a charging mechanism for each type of ink must be arranged.

The method according to Japanese Patent Publication Laid-Open No. 2003-014773 does not intend to force ink droplets to move toward a printing medium, and poses a problem in achieving high-quality printing.

DISCLOSURE OF INVENTION

Accordingly, the present invention is conceived as a response to the above-described disadvantages of the conventional art.

For example, a printing method and printing apparatus using the printing method according to the present invention are capable of actively charging fine ink droplets, controlling the traveling direction of ink droplets by electrostatic force, attaching ink droplets onto desired positions on a printing medium, thereby achieving high-quality printing, and collecting unwanted ink droplets.

According to one aspect of the present invention, preferably, there is provided a printing apparatus which prints by discharging an ink droplet from a printhead onto a printing medium, comprising: ion emitting means for emitting ions into at least a space between an ink discharge portion of the printhead and the printing medium; charging means for charging the printing medium to a polarity opposite to a polarity of ions emitted by the ion emitting means; and printing means for printing by discharging, via the space to which ions are emitted by the ion emitting means, ink from the printhead onto the printing medium which is charged by the charging means.

The printing apparatus desirably further comprises charge removing means for removing charges from the printing medium having undergone printing by the printing means.

The printing apparatus desirably further comprises collecting means for collecting ink mist which is discharged from the printhead for printing by the printing means, is not used for printing, and floating.

The collecting means desirably comprises an electrode having the same polarity as the polarity of the charging means, and a reservoir unit which stores ink of ink mist collected by the electrode and contains an absorber.

In the above configuration, the ion emitting means can take various forms.

For example, the ion emitting means can be arranged near an end of a printing area of the printing medium, and the ion emitting means can comprise an ion generating unit which generates ions, and a fan which diffuses ions generated by the ion generating unit.

In this case, the collecting means is desirably arranged at a position opposite via the printing area to a position at which the ion emitting means is arranged.

As another form, the printing apparatus can further comprise scanning means for reciprocally scanning the printhead, and the ion emitting means can be arranged at a position where the ion emitting means is scanned together with the printhead by the scanning means.

As still another form, in a case where the printing apparatus further comprises scanning means for reciprocally scanning the printhead, the ion emitting means can comprise a first ion emitting unit and a second ion emitting unit at two ends of the printhead in respect with a scanning direction of the scanning means. The first ion emitting unit and the second ion emitting unit can respectively have air inlet ports in the scanning direction of the scanning means.

In this case, it is desirable to, in accordance with the scanning direction of the scanning means, control to emit a large amount of ions from an ion emitting unit on an upstream side in the scanning direction of the scanning means out of the first and the second ion emitting units, or to emit ions from only the ion emitting unit on the upstream side.

In a case where the printhead has a plurality of nozzle arrays each formed from a plurality of ink discharge nozzles, the ion emitting means can also be further interposed between the plurality of nozzle arrays.

Note that charges emitted from the ion emitting means are desirably negative, and the charging means desirably positively charges the printing medium.

However, a polarity of ions emitted from the ion emitting means and a charging polarity by the charging means may be reversed at, e.g., a predetermined interval.

According to another aspect of the present invention, preferably, there is provided a printing method of printing by discharging an ink droplet from a printhead onto a printing medium, comprising: an ion emitting step of emitting ions into at least a space between an ink discharge portion of the printhead and the printing medium; a charging step of charging the printing medium to a polarity opposite to a polarity of ions emitted at the ion emitting step; and a printing step of printing by discharging, via the space to which ions are emitted at the ion emitting step, ink from the printhead onto the printing medium which is charged at the charging step.

In accordance with the present invention as described, ink droplets discharged from the printhead are charged, and a printing medium is charged to a polarity opposite to that of ink droplets. By the electrostatic force, the amount of ink droplets attached onto the printing medium is relatively increased. Moreover, the amount of ink attached to desired positions on the printing medium becomes higher than that according to a conventional art.

The invention is particularly advantageous since the printing quality improves.

Since the amount of fine mist floating in the printing apparatus decreases, the present invention can prevent: (1) contamination of the interior of the printing apparatus by attached ink mist; (2) degradation of the movable characteristic by ink mist which attaches to the movable portion of the printing apparatus, e.g., the movable portion of the carriage; (3) a malfunction of a sensor by ink mist which attaches to the sensor; (4) contamination of the exterior of the apparatus by aggregated ink which leaks from the printing apparatus; and (5) contamination of the next printing medium used for printing by attached ink mist.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIGS. 1 to 3)>

Figure 1:
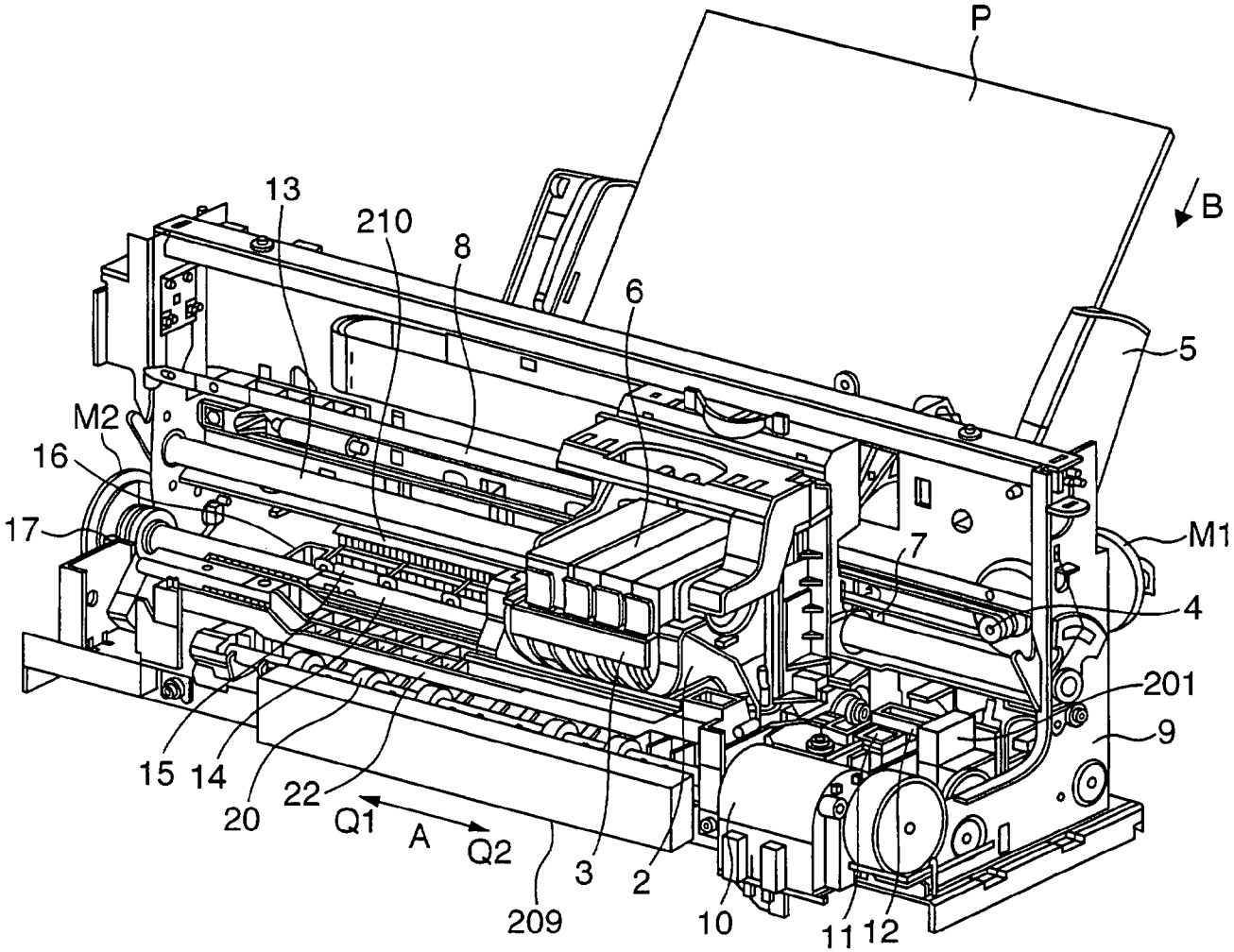
FIG. 1 is a perspective view showing the configuration of an inkjet printing apparatus as a typical embodiment of the present invention.

FIG. 1 is an outer perspective view showing the schematic configuration of an inkjet printing apparatus as a typical embodiment of the present invention.

As shown in FIG. 1, the inkjet printing apparatus (to be referred to as a printing apparatus hereinafter) has a printhead 3 which prints by discharging ink according to the inkjet method. A driving force generated by a carriage motor M1 is transmitted from a transmission mechanism 4 to a carriage 2, and the carriage 2 reciprocates in a direction indicated by an arrow A (in FIG. 1, Q1 represents the leftward direction, and Q2 represents the rightward direction). Upon printing, a printing medium P such as a printing sheet is fed via a sheet feed mechanism 5, and conveyed to a printing position. At the printing position, the printhead 3 discharges ink from downward orifices in FIG. 1 to the printing medium P to print.

In order to maintain a good state of the printhead 3, the carriage 2 is moved to the position of a recovery device 10, and a discharge recovery process for the printhead 3 is performed intermittently.

The carriage 2 of a printing apparatus 1 has not only the printhead 3, but also an ink cartridge 6 which stores ink to be supplied to the printhead 3. The ink cartridge 6 is detachable from the carriage 2.

The printing apparatus 1 shown in FIG. 1 can print in color. For this purpose, the carriage 2 holds four ink cartridges which respectively store magenta (M), cyan (C), yellow (Y), and black (Bk) inks. These four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with the printing signal. In particular, the printhead 3 according to this embodiment employs an inkjet method of discharging ink by using thermal energy. For this purpose, the printhead 3 comprises an electrothermal transducer for generating thermal energy, and electric energy applied to the electrothermal transducer is converted into thermal energy. Ink is discharged from orifices by using a change in pressure upon growth and shrinkage of bubbles created by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 1, the carriage 2 is coupled to part of a driving belt 7 of the transmission mechanism 4 which transmits the driving force of the carriage motor M1. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 used for indicating the absolute position of the carriage 2 is arranged along the moving direction (direction indicated by the arrow A) of the carriage 2. In this embodiment, the scale 8 is prepared by printing black bars (slits) on a transparent PET film at a necessary pitch. One end of the scale 8 is fixed to a chassis 9, and its other end is supported by a leaf spring (not shown). The carriage 2 comprises an encoder (not shown) for reading the slits of the scale 8.

The printing apparatus has a platen (not shown) facing the orifice surface of the printhead 3, which has orifices (not shown). The carriage 2 holding the printhead 3 reciprocates by the driving force of the carriage motor M1. At the same time, a printing signal is supplied to the printhead 3 to discharge ink and print on the entire width of the printing medium P conveyed onto the platen.

In FIG. 1, reference numeral 14 denotes a conveyance roller which is driven by a conveyance motor M2 in order to convey the printing medium P; 15, a pinch roller which makes the printing medium P contact with the conveyance roller 14 by a spring (not shown); 16, a pinch roller holder which rotatably supports the pinch roller 15; and 17, a conveyance roller gear which is fixed to one end of the conveyance roller 14. The conveyance roller 14 is driven by rotation of the conveyance motor M2 that is transmitted to the conveyance roller gear 17 via an intermediate gear (not shown).

Reference numeral 20 denotes a discharge roller which discharges the printing medium P bearing an image formed by the printhead 3 outside the printing apparatus. The discharge roller 20 is driven by transmitting rotation of the conveyance motor M2. The discharge roller 20 contacts with the printing medium P by a spur roller (not shown) which presses it by a spring (not shown). Reference numeral 22 denotes a spur holder which rotatably supports the spur roller.

As shown in FIG. 1, in the printing apparatus, the recovery device 10 which recovers the printhead 3 from a discharge failure is arranged at a desired position (e.g., a position corresponding to the home position) outside the reciprocation range (printing area) for printing operation of the carriage 2 holding the printhead 3.

The recovery device 10 comprises a capping mechanism 11 which caps the orifice surface of the printhead 3, and a wiping mechanism 12 which cleans the orifice surface of the printhead 3. The recovery device 10 uses a suction means (suction pump or the like) within the recovery device to forcibly discharge ink from orifices in synchronism with capping the orifice surface by the capping mechanism 11. Accordingly, the recovery device 10 achieves a discharge recovery process of removing ink with a high viscosity or bubbles in the ink channel of the printhead 3.

In non-printing operation or the like, the orifice surface of the printhead 3 is capped by the capping mechanism 11 to protect the printhead 3 and prevent evaporation and drying of ink. The wiping mechanism 12 is arranged near the capping mechanism 11, and wipes ink droplets attached to the orifice surface of the printhead 3.

The capping mechanism 11 and wiping mechanism 12 can maintain a normal ink discharge state of the printhead 3.

In FIG. 1, reference numeral 201 denotes an ion emitting unit which emits ions of either the positive or negative polarity, and generates many negative ions in this embodiment. The ion emitting unit 201 is made up of a compact fan and an ion generating unit which generates many negative ions. Exactly speaking, the ion generating unit generates both positive and negative ions, but can be regarded to emit ions of one polarity because the ratio of ions of one polarity emitted from the emitting unit is higher than that of the other polarity. In this case, the ion emitting unit can be regarded as a negative ion emitting unit as far as about 70% or more of the ion generation amount is negative ions. The ion generation amount can be measured by an ion counter or the like.

In this embodiment, negative ions emitted by the ion generating unit are moved toward the printhead 3 together with air current.

When ions of the same polarity locally float at a high density, they diffuse. With this characteristic, the distribution of negative ions in the printing apparatus becomes uniform. In this embodiment, however, the fan is used to increase the ion diffusion rate over an ink discharge area or printing area.

Figure 2:
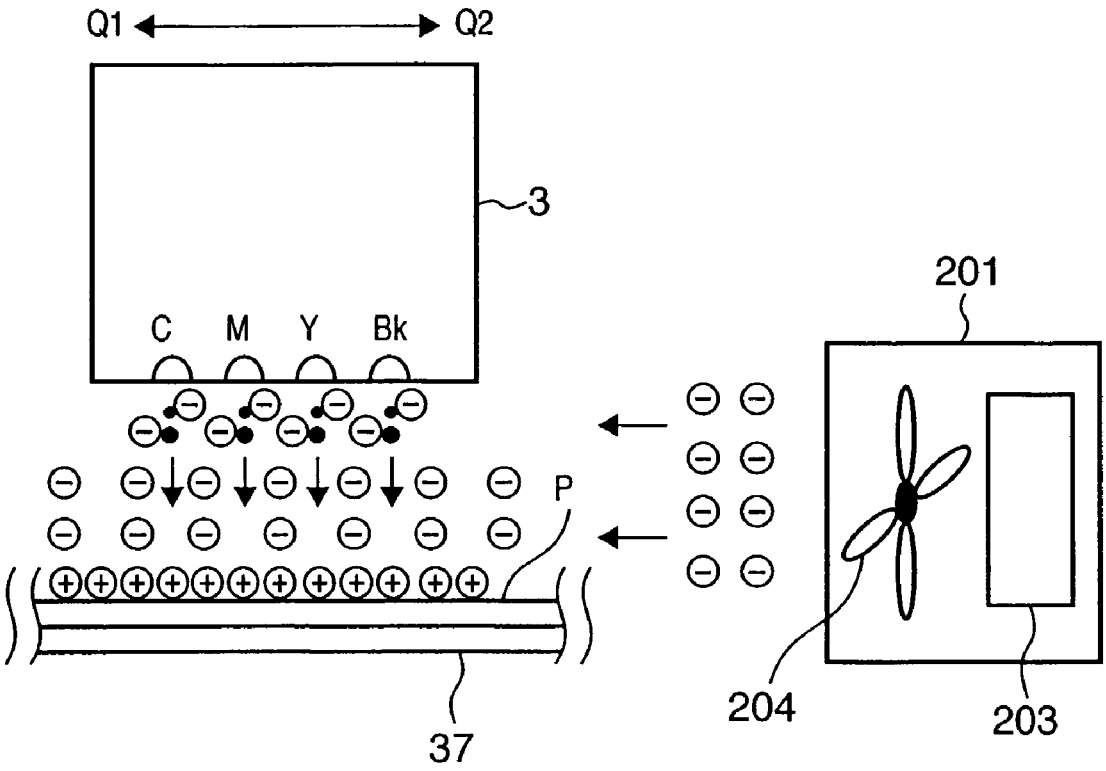
FIG. 2 is a view showing the structure of an ion emitting unit and emission of ions.

FIG. 2 is a view showing the structure of the ion emitting unit 201 and emission of ions.

As shown in FIG. 2, the ion emitting unit 201 is made up of a compact fan 204 and an ion generating unit 203 which generates many negative ions. Negative ions generated by the ion generating unit 203 are diffused by a weak leftward steady flow generated by the fan 204 in FIG. 2. Finally, negative ions dominantly distribute in the space between the printhead 3 and the printing medium P set on a platen 37. In this manner, ions from the ion generating unit 203 which is arranged on the upstream side of the fan 204 can be effectively diffused to the printing area below the ink discharge portion of the printhead 3 by the fan 204 which is arranged in the printing apparatus, thereby filling ions in the printing region.

Figure 3:
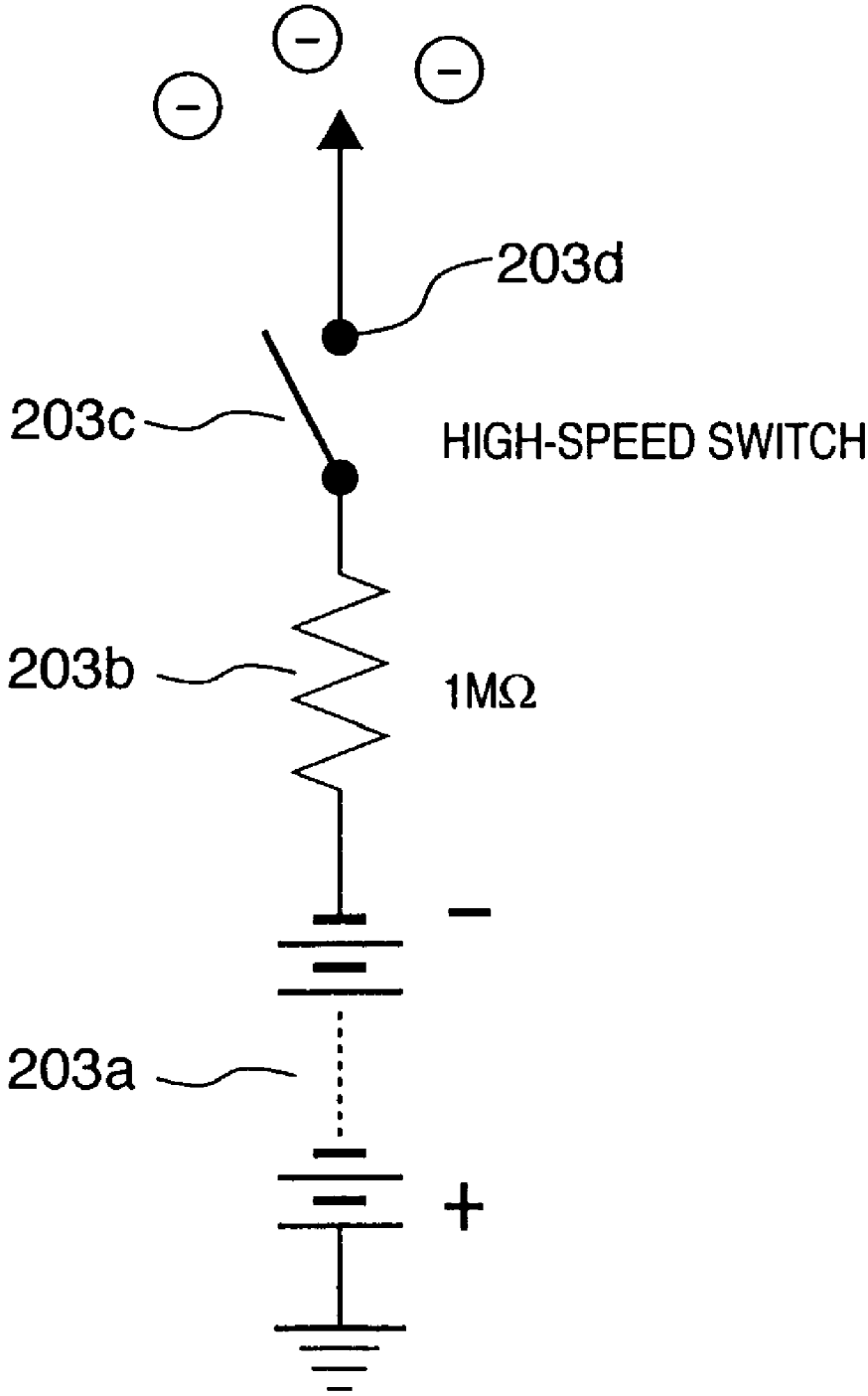
FIG. 3 is a circuit diagram showing an example of an ion generating mechanism used in an ion generating unit.

FIG. 3 is a circuit diagram showing an example of an ion generating mechanism used in the ion generating unit.

There are various negative ion generating means. In this embodiment, as shown in FIG. 3, negative ions are generated by switching a high negative voltage at high speed. A switching element 203*c* is interposed via a 1-MΩ resistor 203*b* in a current path extending from a DC power supply 203*a* for a high voltage of −1,000 V. The switch is repetitively turned on/off by a 1-MHz rectangular wave, and negative ions are generated into air from an electrode 203*d* at one end of the switching element 203*c*.

Note that FIG. 1 shows the inside of the printing apparatus for descriptive convenience. In practical use, the printing apparatus is covered with an outer covering to form a substantially closed space against outside air of the printing apparatus. Hence, negative ions emitted from the ion emitting unit 201 fill the whole interior of the printing apparatus.

Referring back to FIG. 1, reference numeral 210 denotes a charging brush which is Connected to a voltage generating unit. The charging brush 210 is a brush-like electrode which is arranged fully in the widthwise direction of the printing medium P and comes into contact with the printing medium P. The electrode is connected to a positive electrode whose polarity is opposite to that of ions emitted by the ion emitting unit. More specifically, the electrode of the charging brush 210 is connected to a +700-V DC power supply via a 10-MΩ resistor. A current flowing from the electrode is very small, and the potential of the electrode is +700 V.

The printing medium P is conveyed in a direction indicated by the arrow B. In this embodiment, before the printing medium P reaches the printing area of the printhead 3, the surface of the printing medium P is charged to +700 V by the electrode of the charging brush 210. After that, the printing medium P reaches the printing area. When printing operation starts, all ink droplets discharged from the printhead 3 are negatively charged by surrounding negative ions. The charged ink droplets are attracted by the potential of the voltage "+700 V" on the surface of the printing medium, and travel toward the surface of the printing medium P.

Note that the potential of the printhead 3 is "0", and the potential near the ink orifice is also "0".

Reference numeral 209 denotes a charge removing mechanism which removes the charges of the printing medium P charged by the electrode of the charging brush 210. The charge removing mechanism 209 is arranged on the downstream side in the conveyance direction of the printing medium P, i.e., at a position where the printing medium having undergone printing by the printhead 3 is discharged outside the apparatus by the discharge roller 20. The charges of the printing medium having undergone printing are removed upon discharge.

Since the printing medium used is nonconductive, charges move by applying a voltage to the surface of the printing medium. If the printing medium is conductive, the configuration is changed to apply a voltage to the entire printing medium. A voltage may be applied from the lower surface of the printing medium.

<Control Configuration of Inkjet Printing Apparatus (FIG. 4)>

Figure 4:
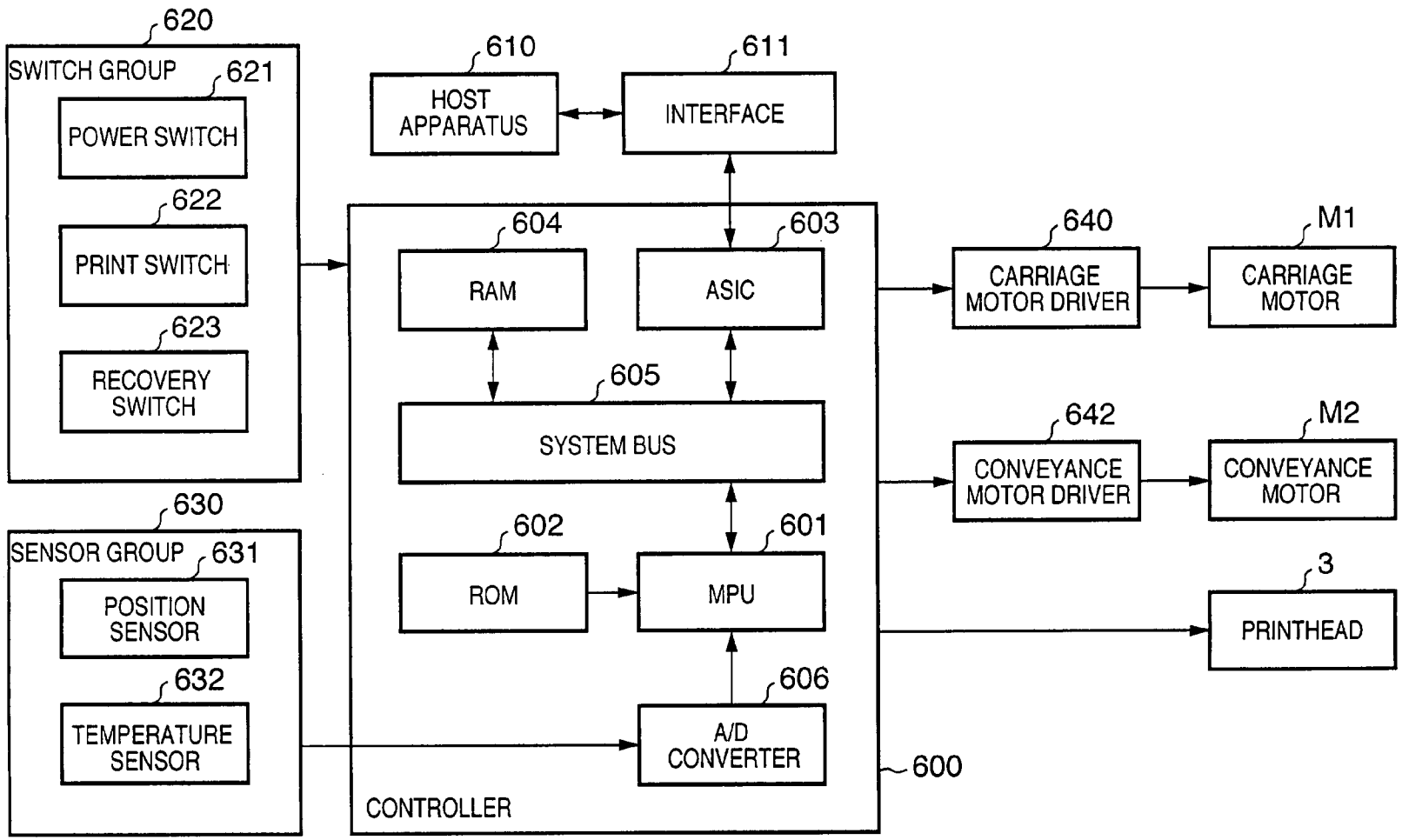
FIG. 4 is a block diagram showing the control configuration of the printing apparatus shown in FIG. 1.

FIG. 4 is a block diagram showing the control configuration of the printing apparatus shown in FIG. 1.

As shown in FIG. 4, a controller 600 comprises an MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other fixed data. The ASIC 603 generates control signals for controlling the carriage motor M1, conveyance motor M2, and printhead 3. The RAM 604 is used as an image data rasterizing area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 4, reference numeral 610 denotes a computer (or an image reader, digital camera, or the like) which serves as an image data supply source and is generally called a host apparatus. The host apparatus 610 and printing apparatus 1 transmit/receive image data, commands, status signals, and the like via an interface (I/F) 611.

Reference numeral 620 denotes a switch group which is formed from a power switch 621, print switch 622, recovery switch 623, and the like. The print switch 622 is used for designating the start of printing. The recovery switch 623 is used for designating the activation of a process (recovery process) of maintaining good ink discharge performance of the printhead 3. These switches are formed from buttons for receiving instruction inputs from the operator.

Reference numeral 630 denotes a sensor group which detects the state of the apparatus and includes a position sensor 631 such as a photocoupler for detecting a home position and a temperature sensor 632 arranged at a proper portion of the printing apparatus in order to detect the ambient temperature.

Reference numeral 640 denotes a carriage motor driver which drives the carriage motor Ml for reciprocating the carriage 2 in the direction indicated by the arrow A; and 642, a conveyance motor driver which drives the conveyance motor M2 for conveying the printing medium P.

In printing and scanning by the printhead 3, the ASIC 603 transfers driving data (DATA) for a printing element (heater) to the printhead while directly accessing the storage area of the RAM 604.

An encoder signal from an encoder (not shown) attached to the carriage 2 is transferred to the MPU 601 of the controller 600 via a position detecting mechanism (not shown).

As described above, the ink cartridge 6 and printhead 3 may be configured to be separated from each other. Alternatively, the ink cartridge 6 and printhead 3 may be integrated into an exchangeable head cartridge IJC.

Figure 5:
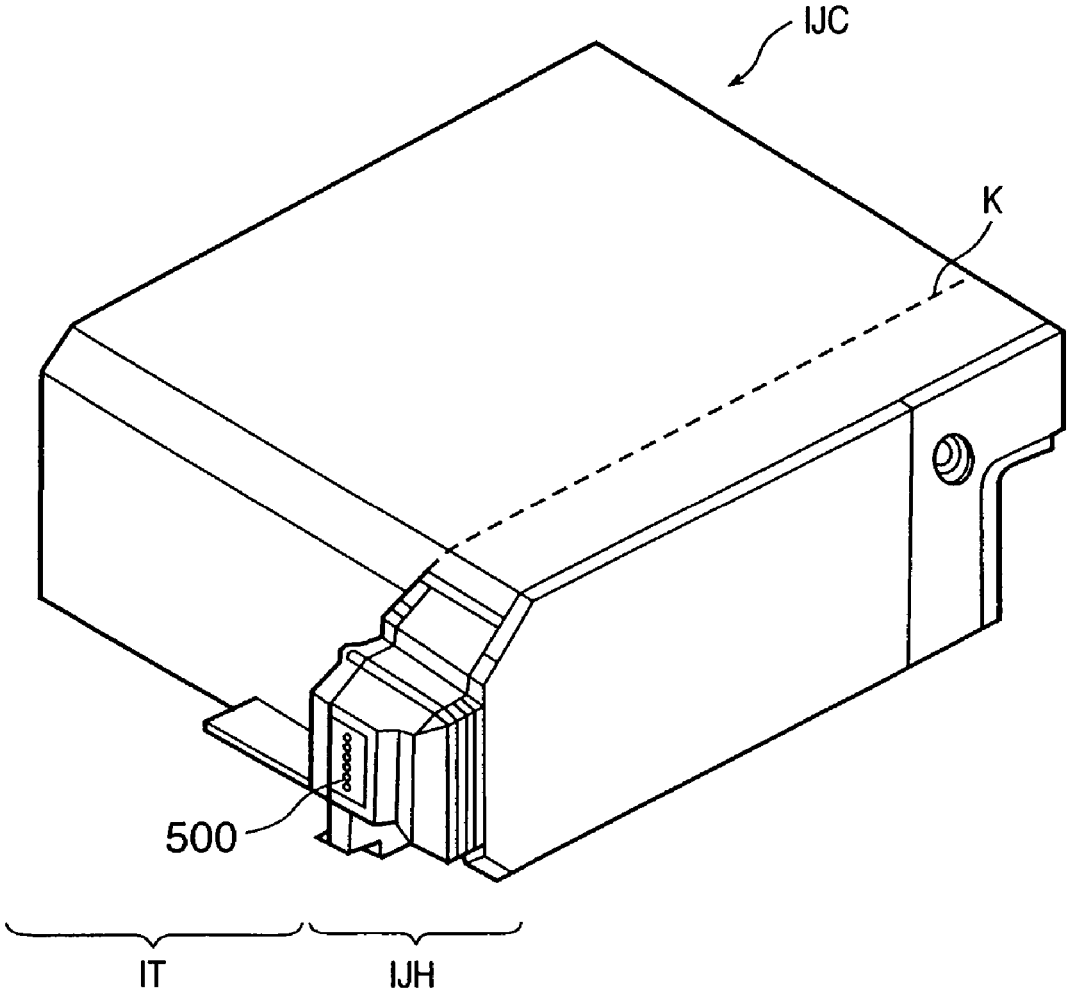
FIG. 5 is an outer perspective view showing the structure of a head cartridge integrating an ink tank and printhead.

FIG. 5 is an outer perspective view showing the structure of the head cartridge IJC integrating an ink tank and printhead. In FIG. 5, a broken line K is a boundary between an ink tank IT and a printhead IJH. The head cartridge IJC has an electrode (not shown) for receiving an electrical signal supplied from the carriage 2 when the head cartridge IJC is mounted on the carriage 2. This electrical signal drives the printhead IJH to discharge ink, as described above.

In FIG. 5, reference numeral 500 denotes an ink orifice array. The ink tank IT is equipped with a fibrous or porous ink absorber in order to hold ink.

Several embodiments of a printing method performed by the printing apparatus having the above configuration will now be described.

First Embodiment

Figure 6:
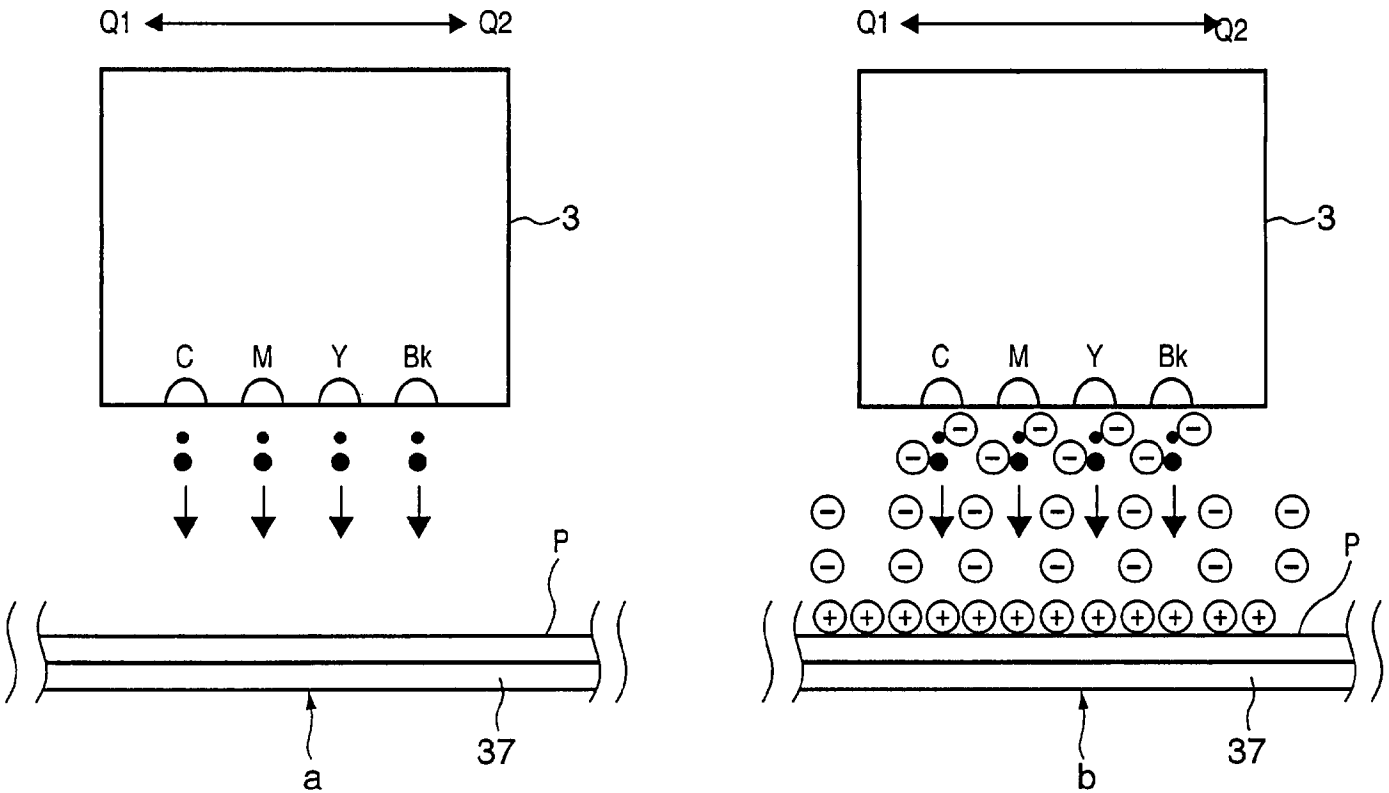
FIG. 6 is a view for explaining the behavior of fine ink droplets according to the first embodiment of the present invention.

Example of Emitting Negative Ions to Printing Area and Positively Charging Printing Surface FIG. 6 is a view for explaining the behavior of fine ink droplets according to the first embodiment of the present invention.

In FIG. 6, a printhead 3 moves above a printing medium P in the left-and-right direction indicated by the arrows Q1 and Q2.

In this case, a in FIG. 6 represents a state in which C, M, Y, and Bk ink droplets discharged from the printhead 3 and represented by black points travel toward the printing medium P and land on the printing medium to form a character or image; and b in FIG. 6 represents a state in which negative ions are emitted to the ink discharge portion or printing area of the printhead 3 to negatively charge ink droplets.

Ink droplets discharged from the printhead 3 originally have a downward momentum in FIG. 6. Ink droplets which are negatively charged by coalescing with emitted negative ions are attracted to the surface of a positively charged printing medium, accelerated, and travel.

The conventional problems and the first embodiment will be compared and examined.

Conventionally, ink droplets discharged from the printhead generally travel straight and attach to a printing medium. However, if the printhead (i.e., carriage holding the printhead) moves at a high speed, ink droplets may attach to unintended positions because of an air flow generated by the movement of the printhead or an air flow generated by ink droplets themselves which are successively discharged from the printhead.

In some cases, fine ink droplets float in the printing apparatus and attach to the interior of the printing apparatus. Such fine ink droplets attach to the next printing medium subjected to printing to contaminate its surface, or attach to, e.g., the light-receiving surface and light-emitting surface of the optical sensor of the printing apparatus to cause a malfunction.

It is conventionally known that when the surface of a printing medium is charged, ink droplets are polarized upon ink discharge and become opposite in polarity between the head and tail ends. If printing is performed in this state, the head end portion of a discharged ink droplet attaches to a desired position on a printing medium. However, the tail end portion of the ink droplet is repulsed by the printing medium, and returns to the printhead without attaching to the printing medium.

On the other hand, according to the first embodiment, negative ions fill the space near the printing area between the printing medium and the printhead, as shown in b of FIG. 6. For this reason, positively charged ink droplets quickly coalesce with negative ions and become electrically neutral. Ink droplets coalesce with many negative ions and are negatively charged. As a result, all ink droplets are negatively charged, and accelerated and travel toward the surface of the positively charged printing medium.

In general, the smaller the size of ink droplets becomes, the larger the accelerating force of fine ink droplets becomes for the same charging amount. Once ink droplets are discharged from the printhead, they are negatively charged in the space between the printhead and the printing medium after the discharge, are accelerated toward the printing medium by electrostatic force, and attach on the positively charged printing medium.

This is an epoch-making method for controlling fine ink droplets in an inkjet printing apparatus. The reason is as follows. A conventional on-demand printhead makes ink droplets fly and attach to a printing medium by kinetic energy upon discharge from the printhead. However, as ink droplets become finer with a smaller volume, i.e., a smaller mass, they are decelerated by a resistance in the air and finally float because their kinetic energy is small. For example, when the volume of an ink droplet is about 2 pl, ink droplets can fly to a printing medium by kinetic energy upon discharge. However, when the volume decreases to 1 pl or less for finer droplets, no kinetic energy enough to fly to a printing medium can be attained.

The behavior of ink droplets changes depending on an air flow generated by successive discharge from the same ink orifice of the printhead or ink discharge from orifices adjacent to the orifice of interest. Ink droplets may attach to unintended positions on a printing medium or float. In order to avoid this phenomenon, it is very important to generate a force for guiding ink droplets toward a printing medium.

In the first embodiment, the printing medium P is positively charged by a charging brush 210 when conveyed to the printing area. Since the printing medium P is flat, ink droplets travel at the minimum distance from the printing medium P as far as the surface of the printing medium P is uniformly charged. In other words, ink droplets travel straight in a direction perpendicular to the printing medium P. As described above, fine ink droplets have small discharge energy, and do not travel straight but often fly with a shift in the upward, downward, rightward, or leftward direction from the printing medium under the influence of an air flow. However, the movement of ink droplets is corrected by electrostatic force which acts between negatively charged ink droplets and a positively charged printing medium, and ink droplets attach to desired positions.

As described above, the present invention proposes epoch-making fine ink droplet control which is completely different from conventional control.

Figure 7:
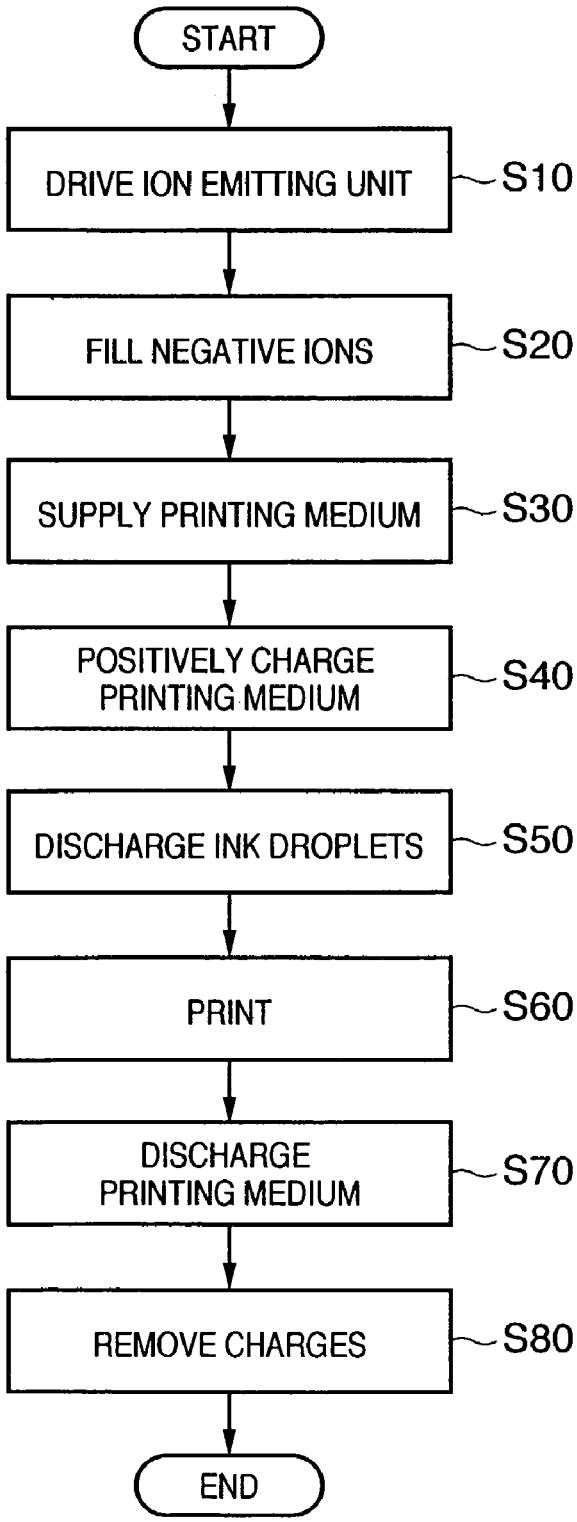
FIG. 7 is a flowchart showing a printing method according to the first embodiment of the present invention.

The above-described method can be summarized into the flowchart shown in FIG. 7.

FIG. 7 is a flowchart showing a summary of the printing method according to the first embodiment.

In step S10, an ion emitting unit 201 is driven to emit negative ions. In step S20, negative ions are diffused with the assistance of an air flow generated by a fan 204, and fill the interior of the printing apparatus. In step S30, the printing medium P is conveyed and supplied into the printing apparatus. At this time, in step S40, the surface of the printing medium P is positively charged by the electrode of the charging brush 210 immediately before the printing medium P reaches the space between the printhead 3 and a platen 37.

In step S50, ink droplets are discharged from the printhead 3. At this time, ink droplets are negatively charged by negative ions which fill the interior of the apparatus, especially negative ions which fill the space between the printhead 3 and the printing medium P, as shown in b of FIG. 6.

Ink droplets flying or floating in the air receive a force to move in the electric field in accordance with the following mechanism.

(1) There is a space (in this case, a space defined between the printhead and a printing medium) where the mist of ink droplets floats in the air.

(2) Negative charge components are emitted from the charge emitting unit (ion emitting unit 201) into the space.

(3) Negative charges are bounded to an oxygen molecule, water particle, and the like in the air, change into negative ion molecules, and float.

(4) Emitted negative ion molecules coalesce with flying or floating ink droplets.

(5) By coalescence, the positive charge components of ink droplets are weakened, and their negative components are strengthened.

(6) Negatively charged ink droplets are attracted to the surface of the printing medium having a positive potential.

By this mechanism, ink droplets discharged from the printhead attach to the printing medium to print in step S60.

In step S70, the printing medium is conveyed to move the printed portion. In step S80, the positive charges of the printing medium are removed by a charge removing mechanism 209.

As described above, the first embodiment can increase the amount of fine ink droplets attached to desired positions on a printing medium, and can improve the printing quality.

Since the amount of fine ink mist floating in the printing apparatus decreases, the interior of the printing apparatus is less contaminated by attachment of ink mist. For example, mist can be prevented from attaching to the movable portion of the carriage and degrading the movable characteristic. For example, mist can be prevented from attaching to the sensor unit and causing the sensor to malfunction. Further, for example, mist can be prevented from floating out from the printing apparatus, contaminating the exterior of the apparatus, and contaminating the next printing medium subjected to printing.

In the first embodiment, negative ions fill the space between a printing medium and the printhead to negatively charge ink droplets and positively charge the printing medium. This is based on experimental results exhibiting that ink droplets tend to be charged negatively. In principle, it is possible to positively charge ink droplets and negatively charge the printing medium. In terms of efficiency, the polarity setting as described in the first embodiment is employed.

It is possible to always generate negative ions and apply a voltage to the charging brush 210 while the printing apparatus is powered. For the safety of the printing apparatus and power saving, it is preferable to only generate negative ions and apply a voltage only during printing.

Second Embodiment

Configuration in which Ion Emitting Unit is Arranged in Printhead

In the first embodiment, the ion emitting unit 201 is arranged at a fixed position in the printing apparatus. However, the present invention is not limited to this. The ion emitting unit may be movable, or move together with the printhead. The second embodiment will describe an example of the ion emitting unit which moves together with the printhead.

Figure 8:
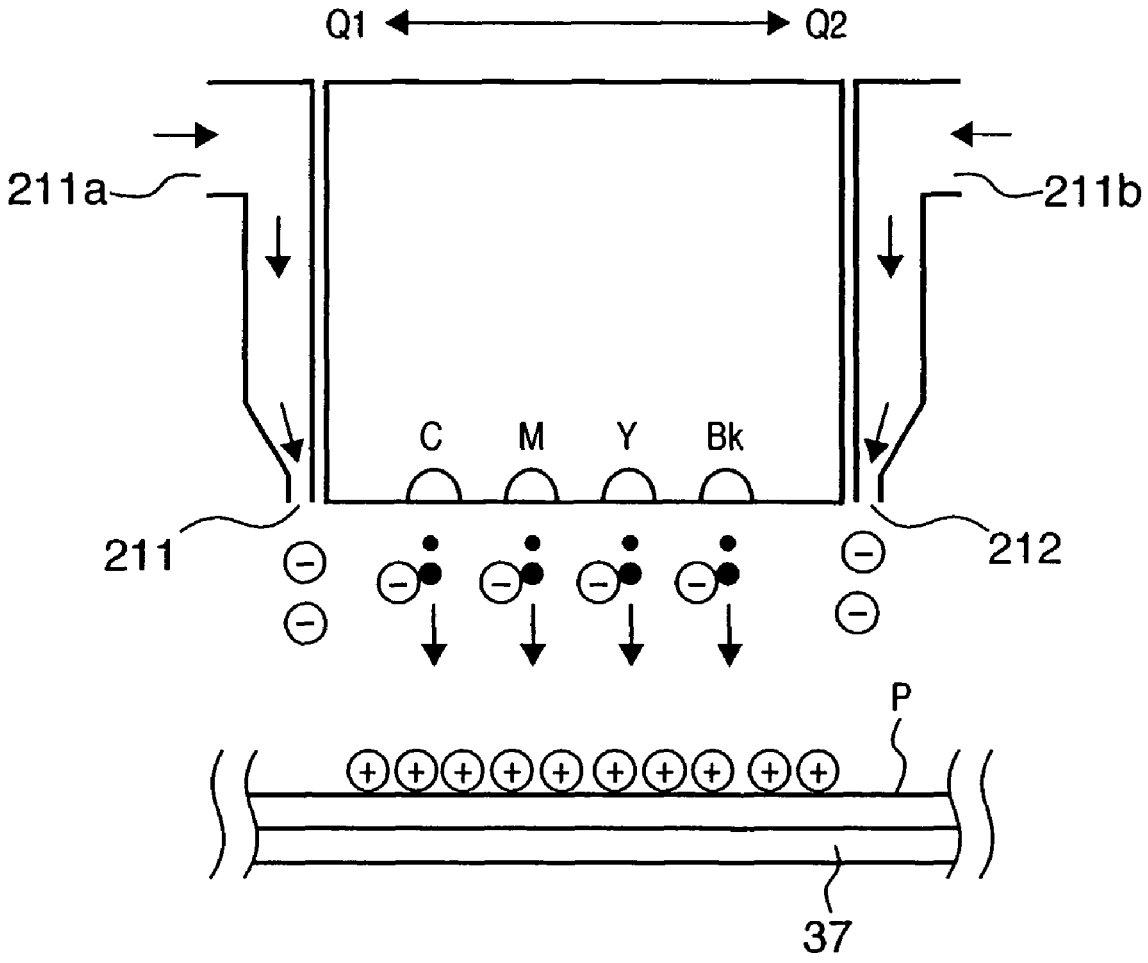
FIG. 8 is a view showing the configuration of an ion emitting unit according to the second embodiment of the present invention.

FIG. 8 is a view showing an example in which ion emitting units are arranged at two ends in the moving direction of a printhead mounted on a carriage.

Ion emitting units 211 and 212 which move together with a printhead 3 shown in FIG. 8 emit negative ions when the printhead 3 reciprocates. Emitted negative ions diffuse around the ink discharge portion of the printhead, in the space between the printhead and a printing medium, and in the printing area where the printhead scans. Negative ions fill these areas. Ink droplets are discharged into the spaces filled with negative ions, and efficiently charged negatively. To the contrary, the printing medium is charged positively, as described in the first embodiment. Negatively charged ink droplets are attracted to the surface of the positively charged printing medium by electrostatic force, are accelerated, and attach on the upper surface of the printing medium.

In the second embodiment, as shown in FIG. 8, openings 211*a* and 211*b* are formed in correspondence with the ion emitting units 211 and 212, respectively. An air flow is taken into the openings 211*a* and 211*b* along with the movement of a carriage 2, and ions are emitted to the space below the printhead by the movement of the carriage 2.

With this relatively simple configuration, ions can be emitted from the upstream side in the moving direction of the printhead. In order to achieve the purpose of emitting ions to the printing area of the printhead, emission from the upstream side in the moving direction of the printhead is the most efficient. Thus, it is useful to emit ions from only the upstream side or emit a larger amount of ions from the upstream side than that from the downstream side.

This point will be explained in more detail with reference to FIG. 8.

When the printhead 3 moves in the direction indicated by the arrow Q1, the ion emission amount from the ion emitting unit 211 serving as the upstream side in the moving direction is set larger than that from the ion emitting unit 212 serving as the downstream side. To the contrary, when the printhead 3 moves in the direction indicated by the arrow Q2, the ion emission amount from the ion emitting unit 212 serving as the upstream side in the moving direction is set larger than that from the ion emitting unit 211 serving as the downstream side.

In this way, the ion generation amount from the upstream side is set larger in the configuration having ion generating units on both the upstream and downstream sides in the moving direction of the printhead.

In the second embodiment, effective ion generation corresponding to operation of the printing apparatus which performs bidirectional printing can be implemented by employing the configuration having two ion emitting units on both the upstream and downstream sides which correspond to the right and left of the printhead 3, as shown in FIG. 8.

Note that ion emission from the downstream side is also significant because it can apply charges to fine ink mist left after the printhead 3 passes and can prevent floating of the mist.

The ion emission method is not limited to the above, and a fan or the like may be added to forcedly diffuse emitted ions. In a configuration having the mechanism of forcedly diffusing emitted ions by the fan or the like, ions can be emitted to the entire printing area regardless of the movement of the printhead.

Third Embodiment

Configuration in which Ion Emitting Unit is Arranged in Printhead

The third embodiment will explain a configuration in which ion emitting units are interposed between a plurality of nozzle arrays in a printhead having the plurality of nozzle arrays.

Figure 9:
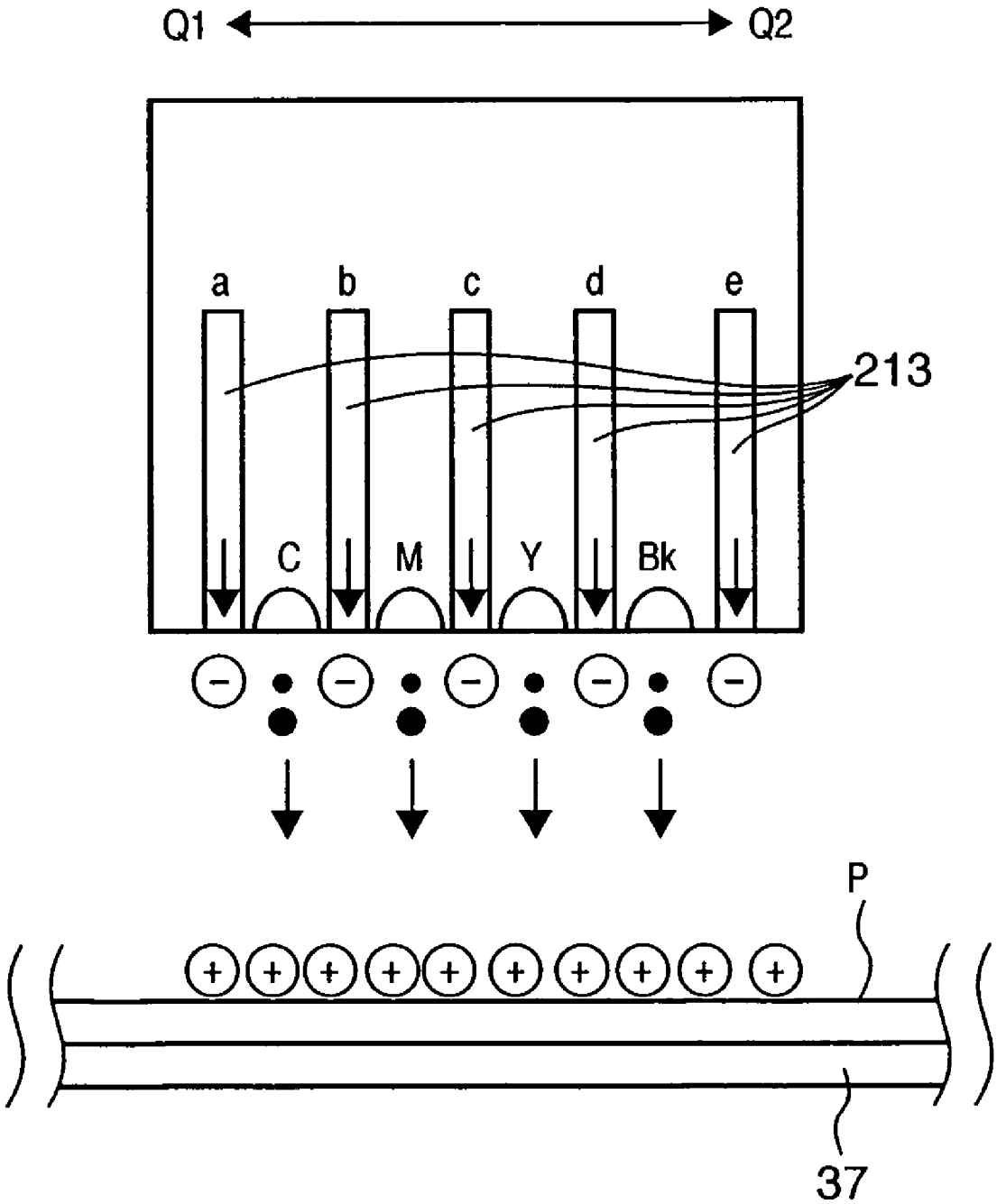
FIG. 9 is a view showing the configuration of an ion emitting unit according to the third embodiment of the present invention.

FIG. 9 is a view showing an example of a configuration in which ion emitting units are interposed between a plurality of nozzle arrays of the printhead.

In the example shown in FIG. 9, four nozzle arrays are formed, and ion emitting units are arranged at five positions. The nozzle array means a nozzle group in which, e.g., 256 ink discharge nozzles are formed for each of magenta (M), cyan (C), yellow (Y), and black (Bk) inks and aligned at equal intervals in a direction perpendicular to the sheet surface of FIG. 9. Ion emitting units 213 are interposed at positions a, b, c, d, and e between the four nozzle arrays (including two ends).

This configuration has an advantage of generating ions in correspondence with each nozzle array and uniformly attaching ions to ink discharged from each nozzle array.

For example, an ion emitting unit may be arranged at only one portion on the upstream side in the moving direction of the printhead, as described in the second embodiment. With this arrangement, when a printhead 3 moves in the direction indicated by the arrow Q1, the ion density may decrease on the downstream side of a nozzle array which discharges C ink. However, according to the third embodiment, ions are emitted from intervals between the nozzle arrays, compensating for a decrease in ion density.

Fourth Embodiment

Example of Collecting Ink Mist

In the first to third embodiments, negative ions are filled in the space around the ink discharge portion of the printhead and the space between the printhead and the printing medium, whereas the surface of a printing medium is positively charged. The fourth embodiment will explain an example of adding a configuration of collecting ink mist generated by ink discharge from the printhead.

Figure 10:
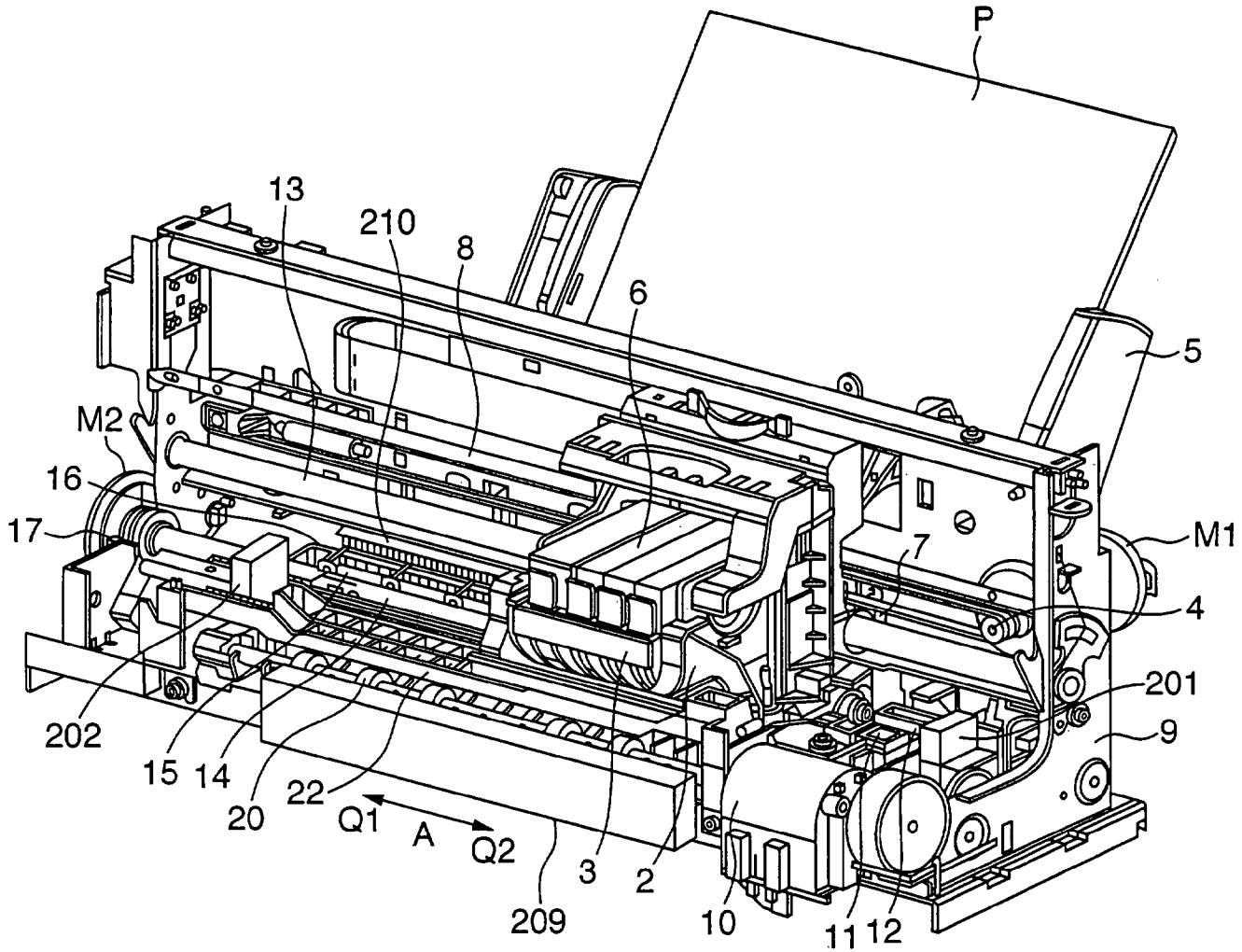
FIG. 10 is a perspective view showing the configuration of an inkjet printing apparatus according to the fourth embodiment of the present invention.

FIG. 10 is an outer perspective view showing the schematic configuration of a printing apparatus according to the fourth embodiment. As is apparent from a comparison between FIGS. 10 and 1, their configurations are almost the same. The same reference numerals denote the same parts, and a description thereof will be omitted.

A characteristic feature of the printing apparatus according to the fourth embodiment is that an ink mist collecting unit 202 is arranged on a side opposite to an ion emitting unit 201 in the moving direction of the carriage.

Figure 11:
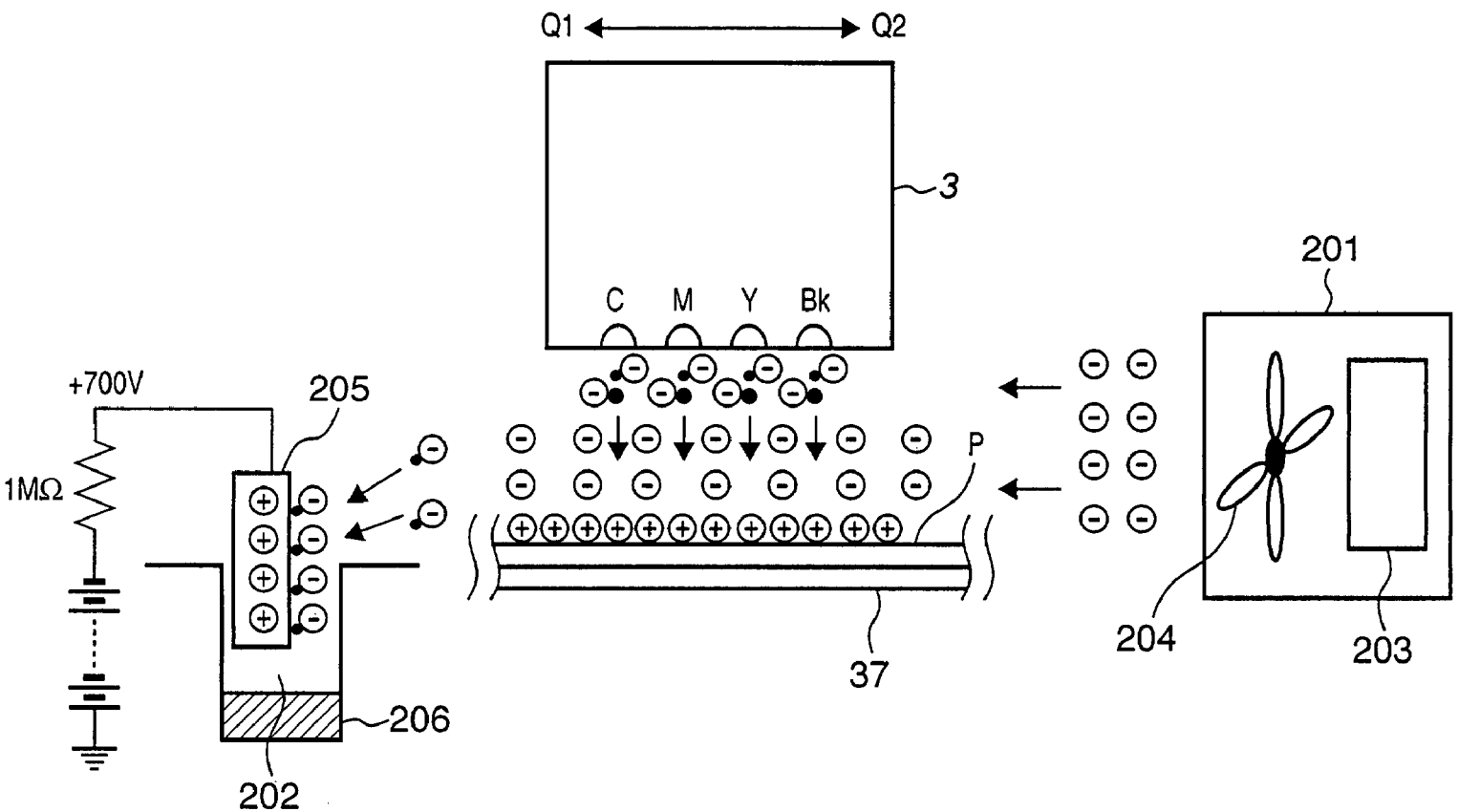
FIG. 11 is a schematic view showing ink collection by an ink mist collecting unit according to the fourth embodiment of the present invention.

FIG. 11 is a view showing the configuration of the ink mist collecting unit, and the relationship between the ink mist collecting unit, the ion emitting unit, the printhead, and the printing medium.

As is apparent from FIG. 11, the ink mist collecting unit 202 collects negatively charged ink mist by an electrode 205 having the same polarity as that of the surface of a printing medium.

FIG. 11 also shows the flow of ions from generation of ions to collection of ink mist, and the flow of ink droplets.

In the ink mist collecting unit 202, the electrode 205 which is vertically arranged has a potential of +700 V with respect to the ground potential of the printing apparatus. A current flowing through the electrode 205 is small, similar to the electrode of a charging brush 210.

Negative ions generated by an ion generating unit 203 are supplied toward a printhead 3 together with air by a fan 204.

Most of ink droplets about 5 μl in volume that are discharged from the printhead 3 attach to a printing medium P and form an image. In contrast, small satellites generated around the tail ends of ink droplets, and fine ink droplets (ink mist) bounded back from a printing medium float in the printing apparatus. If such satellites and fine ink droplets are left to stand, they keep floating in the printing apparatus, thus causing degradation of the printing quality and a failure of the apparatus, as described above.

In the fourth embodiment, fine ink droplets are negatively charged because negative ions fill the interior of the printing apparatus, particularly, the whole space of the printing area scanned by the printhead. Most of negatively charged fine ink droplets are attracted and attach to the surface of a positively charged printing medium. The remaining fine ink droplets travel toward the ink mist collecting unit 202.

As shown in FIG. 11, the ink mist collecting unit 202 is made up of the electrode 205 and a collecting portion 206 having a spongy ink absorber. As described above, a voltage of +700 V with respect to the ground potential of the printing apparatus is applied to the electrode 205. Thus, negatively charged fine ink is gathered to the electrode 205, drops to the collecting portion 206, and is collected.

As described above, according to the fourth embodiment, fine ink droplets which float in the printing apparatus are collected by the collecting unit. This can prevent contamination of the interior of the printing apparatus by attached ink mist, degradation of the movable characteristic by ink mist which attaches to each portion of the printing apparatus, e.g., the movable portion of the carriage, and a malfunction of a sensor by ink mist which attaches to the sensor. Further, this can also prevent contamination of the exterior of the apparatus by aggregated ink which leaks from the printing apparatus, and contamination of the next printing medium used for printing.

The methods according to the first to third embodiments in which the surface of a printing medium is positively charged, ink droplets are negatively charged, and discharged ink droplets are more reliably attached to the printing medium by electrostatic force are very effective for improving the printing quality. Even so, fine ink droplets which float in the apparatus still keep floating in the apparatus for a long time, and contaminate the interior and exterior of the apparatus. However, the fourth embodiment can prevent contamination by ink mist because such floating mist is collected.

In the configuration of the fourth embodiment, as is apparent from FIG. 11, the ion generating unit 203 is arranged on the upstream side of a generated air flow, and the ink mist collecting unit 202 is arranged on the downstream side via the printing area of the printhead. This configuration can efficiently fill ions in the area where the printhead prints, and efficiently collect ink mist.

Fifth Embodiment

In the first to fourth embodiments, the polarity (−) of the ion generating unit, and the polarity (+) to which a printing medium is charged are fixed. However, the present invention is not limited to this polarity setting. For example, the amount of ions leaking from the printing apparatus outside the apparatus can be minimized by changing these polarities.

The amount of ions which are generated according to the embodiments of the present invention and leak outside the printing apparatus is not large, but is preferably minimized in terms of the function of the printing apparatus.

It may be desirable to employ a configuration which reverses the polarity of the ion generating unit, the polarity of the charging brush for charging the surface of a printing medium opposite to the polarity of generated ions, and the polarity of the voltage generating unit of the ink mist collecting unit altogether.

Switching (reversal) of the polarity is alternate for each printing job, and desirably, for each page to be printed.

With this setting, the residues of positive and negative ions become almost equal, and as a result an electrically neutral environment can be obtained.

Of inkjet printing methods, the above embodiments employ a method which uses a means (e.g., electrothermal transducer) for generating thermal energy as energy used to discharge ink and changes the ink state by thermal energy. The present invention can also be applied to a method which generates energy to discharge ink by using a piezoelectric element instead of the electrothermal transducer.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2004-371891, filed Dec. 22, 2004, which is hereby incorporated by reference herein in its entirety.

The invention claimed is:

1. A printing apparatus which prints by discharging an ink droplet from a printhead onto a printing medium, comprising:

ion emitting means for emitting ions into at least a space between an ink discharge portion of the printhead and the printing medium;

charging means for charging the printing medium to a polarity opposite to a polarity of ions emitted by said ion emitting means;

printing means for printing by discharging, via the space to which ions are emitted by said ion emitting means, ink from the printhead onto the printing medium which is charged by said charging means; and collecting means for collecting ink mist which is discharged from the printhead for printing by said printing means and floats without being used for printing.

2. The apparatus according to claim 1, further comprising charge removing means for removing charges from the printing medium having undergone printing by said printing means.

3. The apparatus according to claim 1, wherein said collecting means comprises:

an electrode having the same polarity as the polarity of said charging means; and a reservoir unit which stores ink from ink mist collected by said electrode and contains an absorber.

4. The apparatus according to claim 1, wherein said ion emitting means is arranged near an end of a printing area of the printing medium.

5. The apparatus according to claim 4, wherein said ion emitting means comprises:

an ion generating unit which generates ions; and a fan which diffuses ions generated by said ion generating unit.

6. The apparatus according to claim 4, wherein said collecting means is arranged at a position opposite via the printing area to a position at which said ion emitting means is arranged.

7. The apparatus according to claim 1, further comprising scanning means for reciprocally scanning the printhead, wherein said ion emitting means is arranged at a position where said ion emitting means is scanned together with the printhead by said scanning means.

8. The apparatus according to claim 1, further comprising scanning means for reciprocally scanning the printhead, wherein said ion emitting means comprises a first ion emitting unit and a second ion emitting unit at two ends of the printhead in a scanning direction of said scanning means.

9. The apparatus according to claim 8, wherein the first and second ion emitting units respectively have air inlet ports in the scanning direction of said scanning means.

10. The apparatus according to claim 8, wherein the printhead has a plurality of nozzle arrays each formed from a plurality of ink discharge nozzles, and said ion emitting means are further interposed between the plurality of nozzle arrays.

11. The apparatus according to claim 8, further comprising ion emission control means for, in accordance with the scanning direction of said scanning means, controlling to emit a larger amount of ions from an ion emitting unit on an upstream side in the scanning direction of said scanning means out of the first and the second ion emitting units, or to emit ions from only the ion emitting unit on the upstream side.

12. The apparatus according to claim 1, wherein charges emitted from said ion emitting means are negative, and said charging means positively charges the printing medium.

13. The apparatus according to claim 1, further comprising reversing means for reversing a polarity of ions emitted from said ion emitting means and a charging polarity by said charging means.

14. The apparatus according to claim 13, further comprising reversal control means for controlling to perform the polarity reversal by said reversing means at a predetermined interval.

15. A printing method of printing by discharging an ink droplet from a printhead onto a printing medium, comprising:

an ion emitting step of emitting ions into at least a space between an ink discharge portion of the printhead and the printing medium;

a charging step of charging the printing medium to a polarity opposite to a polarity of ions emitted at said ion emitting step;

a printing step of printing by discharging, via the space to which ions are emitted at said ion emitting step, ink from the printhead onto the printing medium which is charged at said charging step; and a collecting step of collecting ink mist which is discharged from the printhead for printing in the printing step and floats without being used for printing.

16. The method according to claim 15, further comprising a charge removing step of removing charges from the printing medium having undergone printing at said printing step.

* * * * *